United States Patent [19]

Capaul

[11] Patent Number: 4,807,411

[45] Date of Patent: Feb. 28, 1989

[54] ACOUSTICAL PANEL STRUCTURE

[76] Inventor: Raymond W. Capaul, Rte. #3, Wildwood Dr., Aurora, Ill. 60504

[21] Appl. No.: 181,682

[22] Filed: Apr. 14, 1988

Related U.S. Application Data

[63] Continuation-in-part of Ser. No. 98,794, Sep. 21, 1987.

[51] Int. Cl.[4] ..... E04B 1/82

[52] U.S. Cl. ..... 52/144; 52/806; 52/809; 428/116

[58] Field of Search ..... 428/116, 117; 52/806, 52/809, 144, 145

[56] References Cited

U.S. PATENT DOCUMENTS 2,951,004 8/1960 Martin et al. ..... 52/806
4,083,159 4/1978 Hatch et al. ..... 52/809
4,641,726 2/1987 Fearon et al. ..... 428/116
4,685,259 8/1987 Eberhart et al. ..... 52/144

*Primary Examiner*—James L. Ridgill, Jr.
*Attorney, Agent, or Firm*—Wallenstein, Wagner, Hattis & Strampel, Ltd.

[57] ABSTRACT

An acoustical panel structure having a honeycomb core, and thin, dense, sound transmitting glass fiber mat of uniform thickness adhered to each of the opposed major surfaces of the core. A glass fiber sheet of greater thickness than the mats is secured to the outer surface of one of the mats. A decorative coating or layer is provided on the glass fiber sheet. The resulting structure has a noise reduction coefficient of upwards of 75, and a flame spread of less than 25.

8 Claims, 1 Drawing Sheet

ACOUSTICAL PANEL STRUCTURE

This application is a continuation-in-part application of U.S. pending patent application Ser. No. 98,794, filed Sept. 21, 1987, entitled "Demountable Panel Structure".

FIELD OF THE INVENTION

The present invention relates to an improved honeycomb cored acoustical panel.

BACKGROUND OF THE INVENTION

In pending U.S. patent application Ser. No. 98,794 filed Sept. 21, 1987, there is disclosed an acoustical panel structure which comprises a honeycomb core having a thin, dense, sound transmitting substantially homogenous, preformed sheet or mat adhered on each of the major surfaces thereof. One of the mats advantageously is provided with a decorative coating or layer. The structure of said application has a flame spread of less than 25 which qualifies it for a Class A fire rating, and it has a noise reduction coefficient of about 50.

SUMMARY OF THE INVENTION

In accordance with the present invention, an improved acoustical panel structure has been evolved which has important advantages over the structure disclosed in said pending U.S. patent application. More specifically in this connection, the structure of this invention, while retaining all of the features particularly the Class A fire rating and the capability for easy installation on a surface, of the structure of said pending patent application, has a significantly greater noise reduction coefficient, and affords wider and more diverse installation possibilities than the structure of said application. Thus, the structure of this invention has a noise reduction coefficient of upwards of 75, or at least 30% greater than that of the structure of said application. The structure of this invention, moreover, lends itself to fabrication in substantially any size making it suitable for ceiling installations as well as wall installations. These advantages are attained, furthermore, without any appreciable increase in manufacturing costs over the structure of said pending patent application.

DETAILED DESCRIPTION OF THE INVENTION

As stated hereinabove, the acoustical panel structure of the present invention has a number of features in common with the panel structure of pending patent application Ser. No. 98,794. To the extent, therefore, that the structure of this invention comprises elements in common with the structure of said pending application, the subject matter of the application is incorporated herein by reference.

Figure 1:
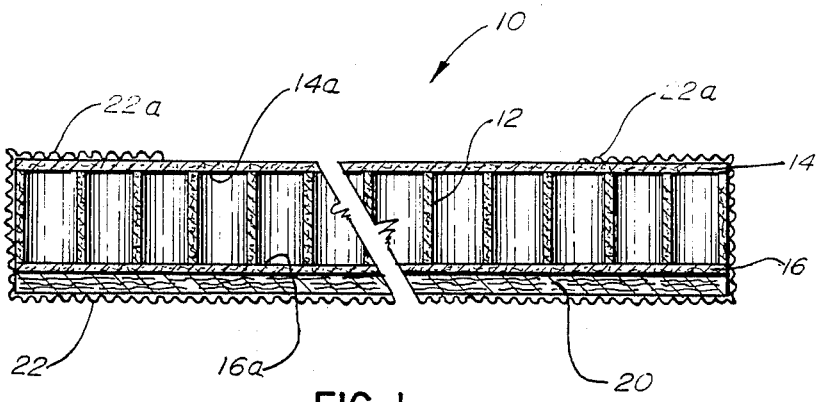
FIG. 1 is a vertical sectional view of an embodiment of the panel structure of the present invention.

Referring, now, to FIG. 1 of the drawing, the embodiment of the panel structure illustrated and designated generally by reference numeral 10, comprises a cellular body portion or core 12 having thin, substantially homogeneous mats 14 and 16 secured to opposite sides thereof. The cellular core 12 preferably is a walled structure such a honeycomb formed of cardboard, kraft paper, plastic, a lightweight metal, or the like. The thickness of the core 12 can range from about $\frac{1}{4}$ inch to about 2 inches, preferably from about $\frac{3}{8}$ inch to about $\frac{3}{4}$ inch, and most preferably about $\frac{5}{8}$ inch. The size of the cells comprising the core 12 can range from about $\frac{1}{4}$ inch to about $\frac{3}{4}$ inch, with a cell diameter size of about $\frac{3}{8}$ inch being preferred.

The mats 14 and 16 are secured to the end edges of the walls which define the cells of the honeycomb core 12. As shown, the inner surface **14*a* and the inner surface 16*a* of the mats 14 and 16 lie in parallel planes and no portion of the inner surfaces 14*a* and 16*a* extends into the cells comprising the core 12. The mats 14 and 16 advantageously are in the form of thin, dense, sound transmitting, substantially homogeneous, non-woven glass fiber sheets having a thickness of about 0.010 to about 0.020 inch, preferably about 0.015 to about 0.018 inch, and a density of about 8 to about 12 lbs. per cubic foot, preferably about 9 about 10 lbs. per cubic foot. The glass fibers comprising the mats 14 and 16** arranged in a random pattern and are bonded together with a residous binder. The density and composition of the mats act to resist penetration by contaminants, and provide a smooth surface which promotes adhesion and film continuity.

The unique advantages of the panel structure of the present invention, particularly from the standpoint of its significantly greater noise reduction coefficient over that of the panel structure of said pending patent application, are attained by applying a glass fiber layer or sheet 20 on the outer surface of one of the mats 14 or 16. As illustrated in the drawing, the sheet 20 is secured to the outer surface of the mat 16. The thickness of sheet 20 can be about 1/16 inch to about 3/16 inch, with a thickness of about $\frac{1}{8}$ inch being preferred. The density of the sheet can be about 6 to about 12 lbs/ft$^3$, preferably about 10 lbs/ft$^3$, more or less.

The sheet 20 advantageously is provided with a coating or layer 22 of a decorative material. The coating or layer 22 can comprise a film of a latex based paint, or, preferably, a sheet formed of open-weave natural or synthetic fabrics, or blends thereof. Especially preferred are fabrics formed of woven, spun or filament plastics such as vinyls, polyesters, polypropylenes, nylons, and glass fibers. The thickness of the decorative coating or layer 22 can be about 2 to about 8 mils, desirably about 4 to about 5 mils. In those instances where the layer 22 is formed of a fabric, the layer 22 advantageously is wrapped around the edges of the structure, and the ends **22*a*—22*a* of the layer 22 are secured along the margins of the outer surface of the mat 14**. This arrangement results in an integrated, lightweight, yet flexible, high-strength structure having a finished, highly attractive appearance.

Figure 2:
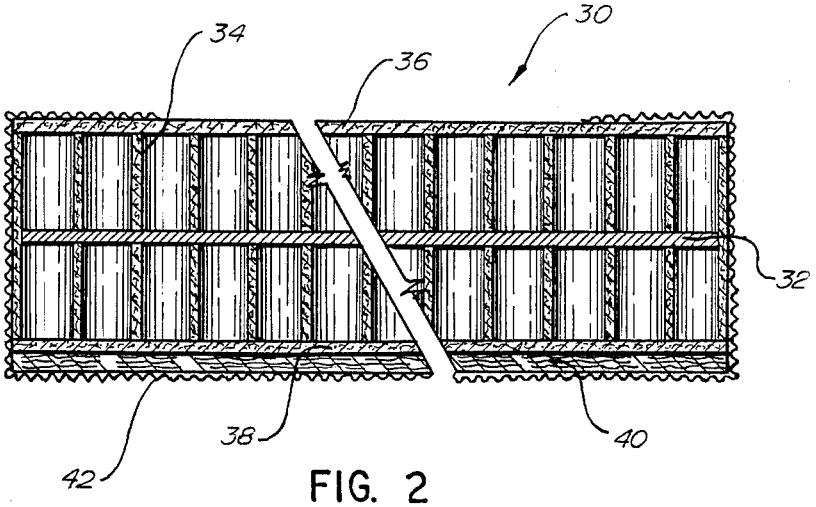
FIG. 2 is a vertical sectional view of another embodiment of the panel structure of this invention showing a septum extending across the honeycomb core.

In the embodiment of the invention shown in FIG. 2 of the drawing, the panel structure, designated generally by reference numeral 30, a septum 32 is incorporated into the honeycomb core 34. The core 24, like the core 12 of the panel structure 10, has thin glass fiber mats 36 and 38 secured, as by adhesion, to the opposed major surfaces thereof. Also, as in the case of the panel structure 10, the panel structure 30 has a glass fiber sheet 40 secured to one of the mats, namely, mat 38, and a decorative coating or layer 42 is adhered to the sheet 40, and wrapped around the edges of the panel structure as described above with regard to the structure 10.

The septum 32 may be formed of a metal foil such as aluminum or lead foil, chipboard, or it may be made of a synthetic plastic film forming materials such as polyethylenes, vinyls, polyesters, and the like. The septum acts to enhance the sound transmission properties of the panel structure 30, and serves to provide an effective barrier to the passage of dirt ladened air through the panel. The thickness of the septum 32 can be about 0.5 mil to about 5 mils, preferably about 2 to about 3 mils.

The panel structure of the present invention, like the panel structure disclosed in pending application Ser. No. 98,794, can be manufactured in an in-line, continuous, high-speed operation at a fraction of the cost incurred in the manufacture of conventional honeycomb cored structures. The panel structure of this invention is especially adaptable to fabrication in a double facing laminating operation which includes the steps of coating both sides of the honeycomb core with a suitable adhesive, and then applying, simultaneously, the thin glass fiber mats 14 and 16 to the adhesive coated surfaces of the core. The glass fiber sheet 20 can then be applied to an adhesive coated surface of one of the mats. The thusly formed laminated structure can then be passed into an oven heated to a temperature of from about 90° to 140° F. to cure the adhesive. From the oven, the structure is passed through a cooling station, and then between nip rollers to assure proper adhesion between the core and the mats, and the layer 20. The thusly formed panel structure can then be cut to size and stacked. Cut panel sizes can range from 2'×2' to 5'×10'. The entire operation can be performed at a line speed of about 40–50 ft/min. If desired, the cut panels can be provided with segments or patches of fastener means such as is disclosed in said pending patent application.

The panel structures of the present invention have, as stated, a noise reduction coefficient of upwards of 75. The flame spread of the panels is less than 25, which qualifies the panels for a Class A fire rating.

While for purposes of illustration representative embodiments of the invention have been shown and described, other embodiments of the invention may become apparent to those skilled in the art upon reference to this disclosure without departing from the spirit and scope of the invention.

What is claimed is:

1. An acoustical panel structure, consisting essentially of: a lightweight core member in the form of a honeycomb having wall portions defining a plurality of hollow, open-ended cells and opposed end cell planes; a pair of thin, dense, sound transmitting, substantially homogeneous, glass fiber mats of substantially uniform thickness and density secured in opposed, substantially parallel relation to one another to said core member along the said opposed end cell planes thereof; and a glass fiber sheet secured to the surface of at least one of said mats, said glass fiber sheet having a thickness greater than, and a density substantially equal to that of each of said glass fiber mats, said panel structure having a noise reduction coefficient of the order of about 75, and a flame spread of less than 25.

2. An acoustical panel structure as claimed in claim 1 wherein each of the glass fiber mats has a thickness of about 0.010 to about 0.020 inch, and the glass fiber sheet has a thickness of about 1/16 to about 3/16 inch.

3. An acoustical panel structure according to claim 1 wherein each of the glass fiber mats has a density of about 8 to about 12 lbs/ft$^3$, and the glass fiber sheet has a density of about 6 to about 12 lbs/ft$^3$.

4. An acoustical panel structure according to claim 1 wherein the core member comprises two sections of substantially equal thickness, said sections having interposed therebetween a septum positioned in substantially parallel relation between said pair of glass fiber mats.

5. An acoustical panel structure according to claim 1, wherein a facing is provided on said glass fiber sheet.

6. An acoustical panel structure according to claim 5, wherein the facing comprises fabric, the edges of which are secured along the margins of the glass fiber mat positioned on the side of said core opposite to that on which said glass fiber sheet is positioned.

7. An acoustical panel structure consisting essentially of: a lightweight core member in the form of a honeycomb having a thickness of about ½ inch to about 2 inches and having wall portions defining a plurality of hollow, open-ended cells and opposed end cell planes; a pair of sound transmitting, substantially homogeneous glass fiber mats secured in opposed, substantially parallel relation to one another to said core member along said end cell planes thereof, said glass fiber mats having a substantially uniform thickness of about 0.010 to about 0.020 inch and a substantially uniform density of about 8 to about 12 lbs./ft$^3$; a glass fiber sheet secured to the surface of one of said glass fiber mats, said glass fiber sheet having a thickness of about 1/16 to about 3/16 inch and a density of about 6 to about 12 lbs/ft$^3$; and a decorative facing on said glass fiber sheet, said panel structure having a noise reduction coefficient of the order of about 75, and a flame spread of less than 25.

8. An acoustical structure according to claim 7 wherein the glass fiber sheet has a thickness of about ⅛ inch and a density of about 10 lbs/ft$^3$.

* * * * *

UNITED STATES PATENT AND TRADEMARK OFFICE

CERTIFICATE OF CORRECTION

PATENT NO. : 4,807,411

DATED : February 28, 1989

INVENTOR(S) : Raymond W. Capaul

It is certified that error appears in the above-identified patent and that said Letters Patent is hereby corrected as shown below:

Column 1, line 17, "homogenous" should be --homogeneous--.

Column 2, line 1, after "such" insert --as--; line 20, after "9" insert --to--; line 21, after "16" insert --are--; line 23, delete "residous" and insert --resinous--; line 60, after "The core", delete "24" and insert --34--.

Column 4, line 42, delete "12 lbs./$ft^3$" and insert --12 lbs/$ft^3$--.

Signed and Sealed this

Twenty-second Day of August, 1989

*Attest:*

*Attesting Officer*

DONALD J. QUIGG

*Commissioner of Patents and Trademarks*